US005272284A

United States Patent [19]

Schmanski

[11] Patent Number: 5,272,284

[45] Date of Patent: Dec. 21, 1993

[54] SOUND BARRIER

[75] Inventor: Donald W. Schmanski, Carson City, Nev.

[73] Assignee: Carsonite International Corp., Carson City, Nev.

[21] Appl. No.: 824,108

[22] Filed: Jan. 22, 1992

Related U.S. Application Data

[63] Continuation-in-part of Ser. No. 728,189, Oct. 7, 1991, Pat. No. 5,217,771.

[51] Int. Cl.[5] ..... E04H 17/00

[52] U.S. Cl. ..... 181/210; 181/284; 181/286; 181/290; 52/144

[58] Field of Search ..... 181/284, 286, 287, 290, 181/291, 294, 210; 52/144, 145; 405/286

[56] References Cited

U.S. PATENT DOCUMENTS

| | | | |
|---|---|---|---|
| 884,354 | 4/1908 | Bertrand | 405/286 |
| 2,423,199 | 7/1947 | Milnor | 181/290 |
| 3,948,009 | 4/1976 | Bernhard | 52/144 |
| 4,143,495 | 3/1979 | Hintz | 181/290 |
| 4,899,498 | 2/1990 | Grieb | 52/144 |

*Primary Examiner*—Michael L. Gellner
*Assistant Examiner*—Eddie C. Lee
*Attorney, Agent, or Firm*—Thorpe, North & Western

[57] ABSTRACT

A sound wall for placement along a roadside for reducing the transmission of sound from a traffic area wherein the sound wall comprises a plurality of stiff, resilient containment members respectfully configured with the channel configuration and having an enclosed channel volume and continuous open side. Each channel volume is filled with a composite composition of rubber chips and binder compressed within the channel and substantially filling the channel volume. These containment members are stacked in nesting relationship to form a wall structure, with the open side being oriented toward the traffic area.

16 Claims, 3 Drawing Sheets

SOUND BARRIER

This is a continuation-in-part of U.S. patent application Ser. No. 07/728,189 filed on Oct. 7, 1991 by the same title now U.S. Pat. No. 5,217,771.

BACKGROUND

1. Field

The present invention relates generally to sound barriers and more specifically to a system for absorbing sound waves emanating in particular from highways, railroads, and similar transportation systems.

2. Prior Art

Since the advent of complex motorized transportation systems, such as railroads, automobiles and airplanes, there has been a need to reduce or prevent noise caused by such systems from effecting surrounding neighborhoods and businesses. Consequently, a number of devices and systems have been created which have been somewhat effective in alternating such noise.

Common barriers such as fences constructed of wood or a similar lightweight material probably served as the first noise barriers. While effective in preventing sight access, such barriers are quite ineffective in preventing the transmission of sound waves.

Concrete or masonry barriers and barriers constructed of a similar heavy material are perhaps more commonly used in attempting to prevent noise transmission. Barriers constructed of concrete are far superior to wood structures in accomplishing this goal, and yet it has been determined that concrete barriers and the like tend more to deflect sound waves rather than to dampen or absorb the same. Hence, while these types of barriers seem to be suitable for the accomplishment of some tasks along a highway or railroad track, they leave much to be desired in the area of preventing sound wave transmission.

Lately, much experimentation has been done with barriers having extruded members, particularly those which are modularly connected together, some of which are constructed of thermoplastic materials which absorb rather than deflect sound waves. Such structures may be effective in dampening much of the noise generated by highway traffic, locomotives, airplanes, and the like, although these barriers are not as effective as desirable. Furthermore, many of these barriers are constructed of materials which break down quickly or lose their resiliency when subjected to adverse conditions such as extreme weather and high-velocity impacts with foreign objects.

U.S. Pat. No. 3,948,009 discloses a sound insulating wall which is made from a composite of rubber shavings having a size within the range of 1 to 20 cubic centimeters incorporated with a binder of reactive resin. This composite is formed into a board which can be inserted at its ends into a pair of vertical supports. These boards are designed for improved absorption of sound by providing full exposure of the composite to the sound environment. Strength for the boards is supplied by increasing the board thickness or by reinforcing the interior of the board with wire (col 5, line 10) or other mechanical inserts.

Unfortunately, the nature of the composite of tire shavings and binder makes the board vulnerable to vandalism and breakage due to impact. Because its surface is substantially exposed, vandals can readily cut and tear away the aggregate structure. Furthermore, the structural weakness of the composite results in breakage on impact, even when reinforced internally. The extensive surface exposure also invites degradation by the elements, based on a tendency of the composite to flake and separate. Although, there is advantage over the prior art sound wall structure, this patent teaches the need to go to the extreme construction wherein sound absorbing properties of the material dictate the choice of a soft surface construction which is vulnerable to wear and failure.

What is needed is an improved sound absorbing wall which offers the strength of earlier constructions such as wood and metal, but which also incorporates the requirement of absorption of sound, rather than merely sound reflection. Such a system would advantageously be resilient and capable of surviving modest impacts, and also be capable of some structural support functions as well as provided the maximum sound absorption of a soft rubber surface.

BRIEF SUMMARY AND OBJECTS OF THE INVENTION

Accordingly, it is a principal object of the present invention to provide a system for dampening and deflecting sound waves and which is strong and resilient, while providing a surface which absorbs sound waves.

Another principal objective of this invention is the provision of a barrier which prevents both sight access and the transmission of sound waves therethrough.

A further major objective of this invention is to provide a system for dampening sound waves which can be erected adjacent a major transportation structure, such as a highway, railroad track, or airport, and be capable of surviving impacts with foreign objects.

Still another important object of this invention is the provision of a device for dampening sound waves which is sturdy, economical, long-lasting, easily manufactured and installed, and relatively inexpensive based on use of recycled tires and thermoplastics.

Another principle objective is to provide a device for absorbing sound waves, several devices disposed adjacently forming a system and each device having a core member for the absorption of some sound, and an outer member capable of protecting and providing structural strength to the core material.

These and other important objects of the invention are realized in the preferred embodiment thereof which is a device for absorbing and attenuating the transmissions of sound wherein the device, comprises a channel containment member formed of metal or fiber reinforced resin, and a core filler of composite material formed of rubber chips bound in a chemical binder and compressed within the channel of the containment member.

A second embodiment of this invention includes a tongue in groove structure on the outside lateral faces of the containment member, combining to provide for nesting of a series of members together to form a wall or barrier system.

The above and other objects, features and advantages of the invention will become apparent from a consideration of the following detailed description presented in connection with the accompanying drawings in which.

DETAILED DESCRIPTION

Figure 1:
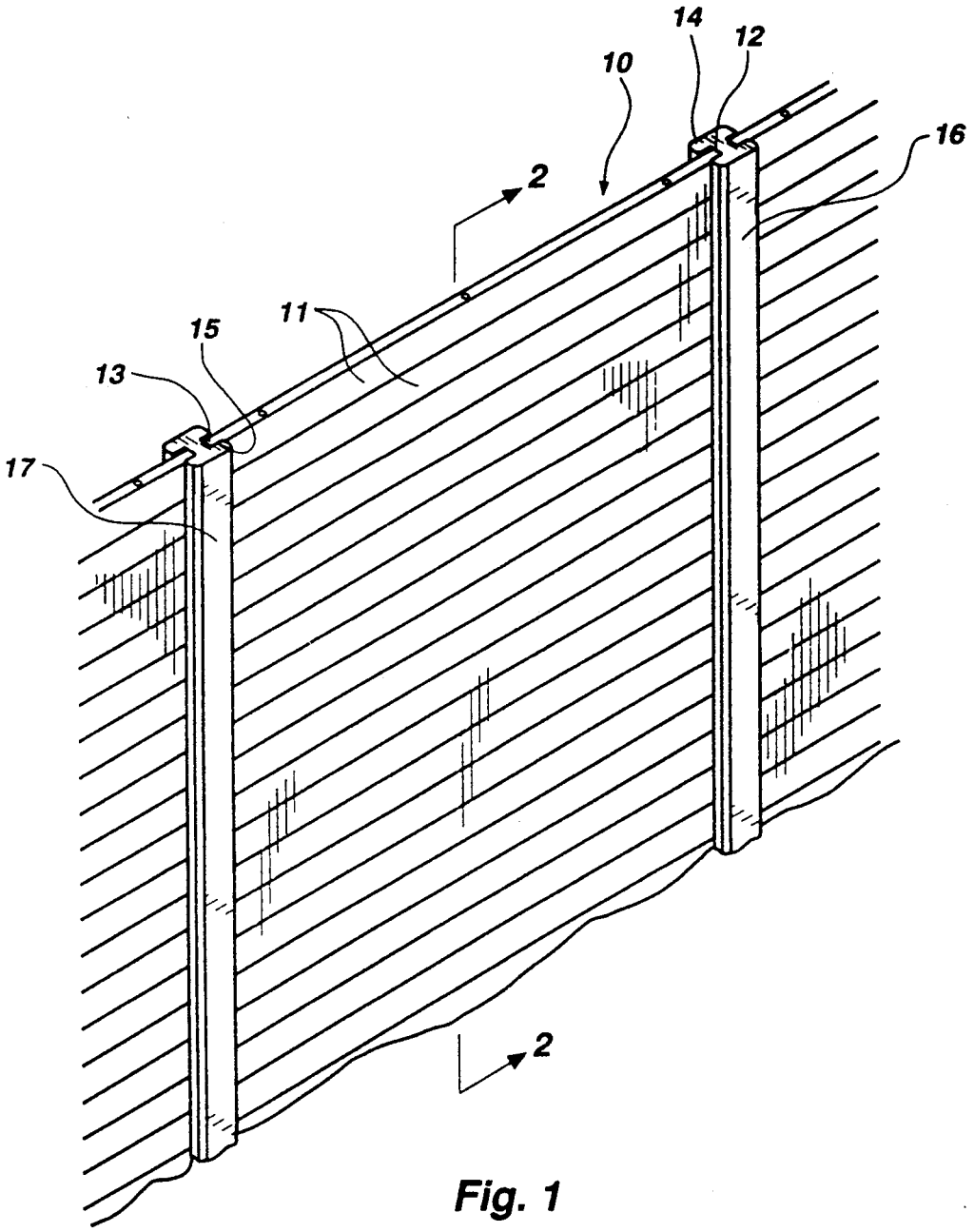
FIG. 1 is a perspective view of a sound barrier embodying the present invention.

FIG. 1 illustrates a fence or a barrier 10 which has demonstrated surprising effectiveness in reducing sound transmission such as arises along highways and other traffic areas. Typically, the barrier 10 would be positioned at a displaced distance from the highway and would act as a barrier to reflect and absorb sound generated in traffic area.

The barrier is constructed utilizing horizontal structural members 11 which are effective in reducing transmission of sound by both reflection and by sound absorption. These horizontal structural members 11 are stacked to form a vertical wall, with opposing edges 12 and 13 being journaled in opposing slots 14 and 15 formed with upright support members 16 and 17. A more detailed description of these components is set forth in connection with the description associated with subsequent figures.

Figure 2:
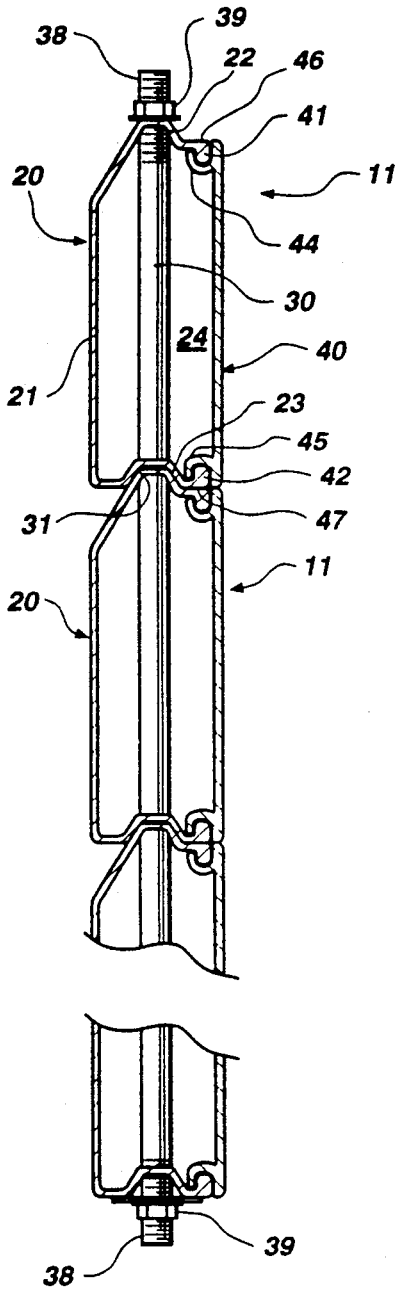
FIG. 2 is a cross section taken along the lines 2—2 of FIG. 1 and is depicted with the core material not shown.

For example, FIG. 2 is a representative cross section taken along the verticle height of the sound barriers shown in FIG. 1. Although the figure illustrates only two complete structural members 11, it is to be understood that the plurality of stacked horizontal members which form the sound barrier are of common configuration and will be represented by the two members illustrated in FIG. 2. Each horizontal structural member 11 provides a device for reducing the transmission of sound arising from a traffic area or other source of sound origination.

These devices comprise a stiff, resilient containment member 20 which is configured as a channel on sides 21, 22 and 23. These three sides enclose a channel volume 24 which is filled with a composite composition 25 (FIG. 3) of rubber chips and binder compressed within the channel and substantially filling the channel volume. This composition is not shown in FIG. 2 to permit view of a support rod 30 which secures and stabilizes the array of horizontal structural members il in their aligned and vertical orientation. A cover plate 40 is attached at opposing edges 41 and 42 of the containment member 20 as is discussed in greater detail hereafter. This cover plate 40 is constructed of a perforated material or of such other construction as will permit the transmission of sound waves therethrough.

Figure 3:
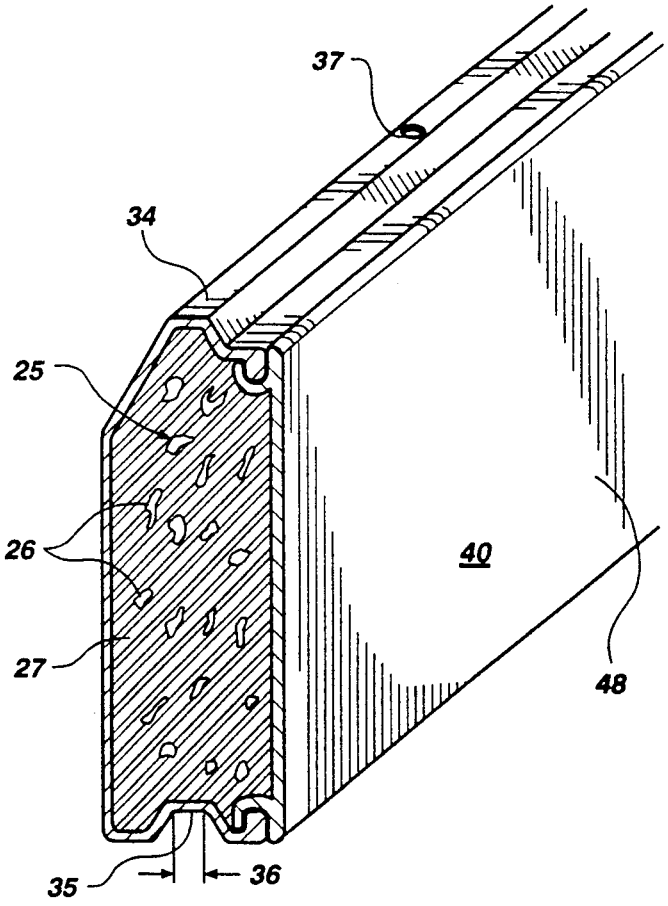
FIG. 3 is an isolated perspective view of a single device or structural member showing a cross section taken at one end.

The containment member 20 provides the structural strength to the barrier and is constructed of a stiff, resilient material such as metal or fiber reinforced plastic compositions. For example, galvanized steel or extruded aluminum may be used to provide a metal structure which is capable of providing the necessary support and containment of the sound absorbing material placed within the channel volume 24. Plastic composites such as fiber reinforced thermosetting resin may likewise be utilized for the containment member and will typically be fabricated by a well known pultrusion process which is well adapted for generating uniform cross section such as is illustrated in FIGS. 2 and 3. The advantage of the fiber reinforced composite composition is weatherability, in combination with strength. Any combination of these materials may be selected based on the environment to which it is to be applied, along with cost considerations.

Where a fiber reinforced thermosetting resin is utilized, an acceptable dimension of wall thickness is one hundred and twenty five thousandths of an inch for a ten foot span. The distance from the back wall 21 of the containment member to the cover plate 40 is approximately two inches. The verticle height of the device extends from its bottom wall 23 to a top wall 22, a distance of approximately 6.4 inches. These dimensions will vary, depending on the length of span and the sectional modules needed to provide a desired wind load resistance. Typically, a highway application of this sound barrier requires a wind load resistance or 100 m.p.h.

The bottom wall is configured with a trapezoidal shaped cavity 31 which provides a nesting position for a top portion of the top wall 22 which has a trapezoidal shape and permits the device 11 to be stacked and nested in a stable configuration as is shown in FIG. 2. It will be apparent to those skilled in the art that numerous geometric variations can be selected to implement the desired nesting structure which enables the devices to be stacked with the respective bottom wall of each device nesting in the top wall of each supporting device. In the illustrated embodiment of FIGS. 2 and 3, the contact face 34 of the top wall and a corresponding contact face 35 of the bottom wall are dimensioned to approximately 0.375 inches (see item 36).

The verticle stacked arrangement of these containment members 11 is maintained by a support rod 30 which is inserted through an opening 37 in the top face 34 of each containment member. These openings 37 are aligned with similar openings in the bottom wall of each containment member to enable insertion of the rod 30 through the full length of the wall. These rods may be constructed of many durable materials such as steel and are threaded 38 to enable attachment of as hexagonal nut 39 at each end to provide secure attachment. The top of the bolt can include a piece of decorative hardware (not shown) which may be inserted on the upper portion of the threads 38.

As has been mentioned earlier, the containment member has an open side 24 which projects toward the source of sound waves to be reflected or absorbed. For aesthetic and protective reasons, the composite material 25 contained within the channel volume may be covered by a cover plate 40. FIGS. 2 and 3 illustrate an embodiment for attachment of this cover plate 40 at the top 22 and bottom 23 walls of the containment member. In this embodiment, the top 41 and bottom 42 edges which define top and bottom boundaries of the channel opening are configured as mounting lips which can be snapped in place by use of a tongue and groove configuration 44 and 45. This is attached near a pair of parallel edges 46 and 47 which form part of the top and bottom walls respectively.

These parallel edges 46 and 47 provide contacting faces wherein the forward projecting open side and cover plate form a continuous wall along the total height of the sound barrier. This cover plate may be formed of perforated material (represented by cross hatching 48 in FIG. 3) or other materials which permit the transmission of sound waves through the cover plate and into the composite core 25.

An unexpected feature of the present invention is that use of a cover plate actually increases sound reduction, as measured by the standard sound reduction coefficient SRC. Tests of the present invention showed that the SRC value for the described containment member with composite was an average value of 0.55 for frequencies ranging up to 5000 hz, when no cover plate was used. With an attached cover plate having an expanded metal or perforated configuration, the SRC increased to an average value of 0.6 for the same frequency range. It is believed that the cover plate operates to trap some of the sound waves within the containment member by reflecting them back toward the composite. This finding further emphasizes the need to consider SRC for sound barriers, as well as the traditional sound transmission coefficient. It will be apparent that other configurations besides the planar cover plate shown in FIGS. 2 and 3 could be adopted. For example, ribbed structure could be adopted in a non-planar configuration with curves or angled junctions to provide different sound reflection properties to the cover plate, as well as varying the aesthetic appearance of the wall. It will be apparent to those skilled in the art that numerous variations are permissible within the basic inventive concepts disclosed with respect to the cover plate and accompanying containment structure.

The combined containment member 29 and cover plate 40 cooperate to enclose sound absorbing material identified as composite 25. A significant feature of this invention is the adaptation of a composite which is made up of recycled tires. Such tires may be ground, shaved or otherwise broken into crumbs or chips 26 to facilitate a good dispersion within a binder material 27. It has been discovered that smaller sized crumbs or shavings 26 provide preferred and unexpected attenuation of sound when bound within some type of rigid matrix such as polymer or cement material. The sound waves are absorbed by the tire component, thereby reducing sound transmission.

There is a wide variety of thermoplastic and thermosetting polymers which can be successfully used as the binder material and which also complement the tire component by enhancing or providing some sound absorption property. Such materials as polyurethane, polyesters, phenol formaldehyde, resorcinol formaldehyde or vinyl acetate, etc., are suitable polymers for use as binder material 27. Appropriate composition for the binder to tire component are in the range of 10 percent to 50 percent binder to total weight. A preferred composition which has demonstrated excellent sound attenuation comprises 80 percent tire crumb and 20 percent vinyl acetate. Tire crumb composition is reduced in size to less than one centimeter cubed and provides an easily workable material at lowest possible cost.

The composite material is prepared by mixing the tire crumb with the binder to disperse the binder throughout the tire crumb material. The binder should flow sufficiently between the tire crumb particles to bind larger particles continuously throughout the composition. Typically, the tire crumb material is blended with the binder and curing agents, and is then compression molded or extruded into the channel volume. One advantage of the present invention is that the composite material is capable of mixing and then dispensing through an extrusion gun to develop preferred dispersion and uniform consistency throughout the material.

The composite may also be formed of tire crumbs and Portland cement or a similar type of binder. It has been demonstrated that 80 percent tire crumb and 20 percent portland cement form an effective composite insert within the subject containment member and provide effective sound attenuation. An advantage of the cement binder is low cost and ease of processing. Production of the composition can be accomplished in a simple cement mixer in which the tire crumbs are blended with a liquid suspension of Portland cement in an 80:20 ratio.

The mixture can then be poured directly into the channel volume and cured.

Figure 4:
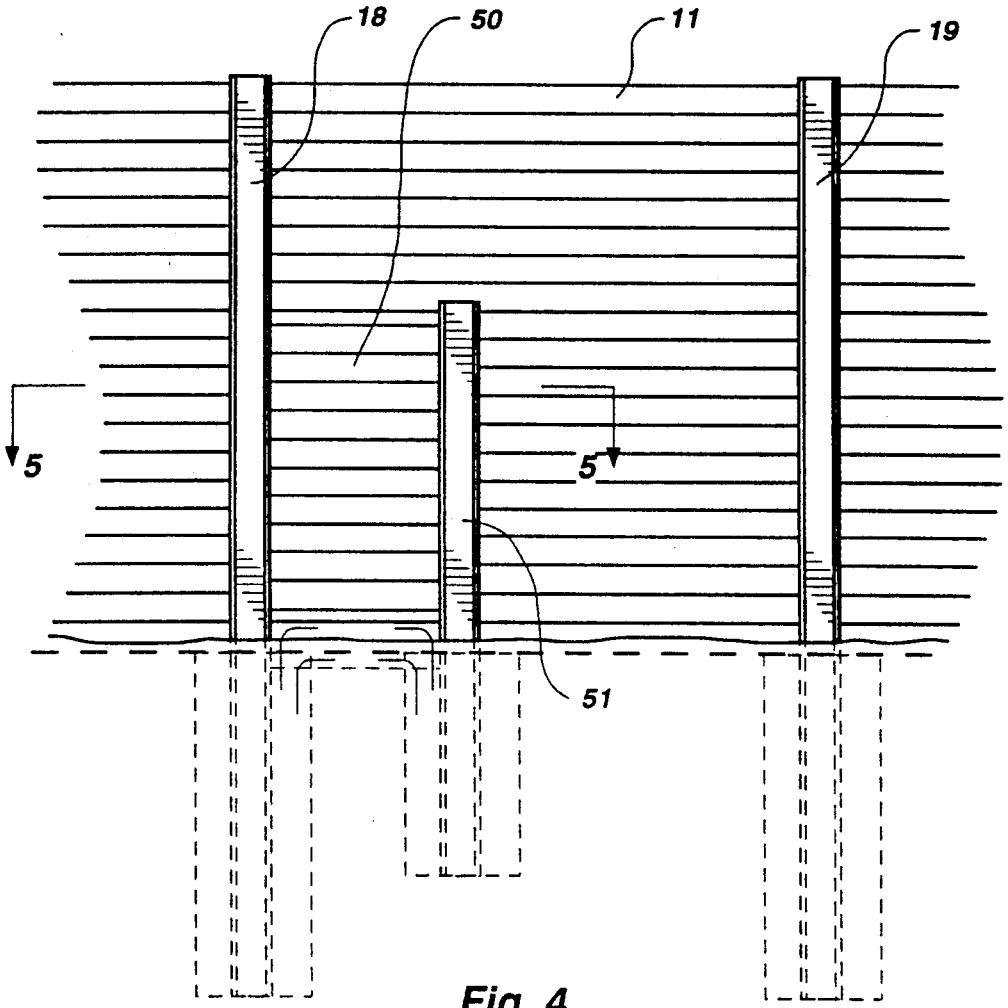
FIG. 4 is a plane frontal view of a sound barrier including a door section.

FIGS. 1 and 4 illustrate the stacked configuration and individual members The containment member with its composite core is well suited for use as a structural member as illustrated in FIGS. 1 and 4. Specifically, these devises can be positioned horizontally between support posts 16, 17, 18 and 19 in a nested configuration as is shown in FIG. 2. When used as part of a sound wall, these devices provide the ability to reflect sound back towards the traffic area or other source of sound interference as well as to absorb a portion of the sound transmission within the composite material.

This functional duality is an important consideration in view of studies which show that in a highway environment, sound is passed back and forth between opposing sound barriers and is spilling over the top of the wall and entering the community at about two hundred feet beyond the sound barrier. Therefore, although prior art walls, may have an approximate 20 db noise drop, they are only effective very close behind the wall. Accordingly, the present invention utilizing a plurality of stacked sound absorption devices enables not only reflection of sound, but absorption of sound transmission passing through the cover and into the composite.

Figure 5:
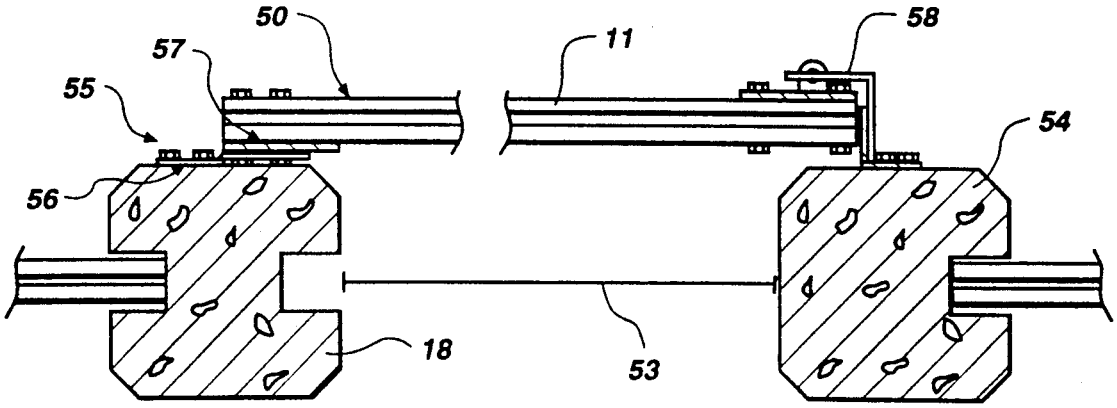
FIG. 5 is a cross sectional view taken along the lines 5—5 of FIG. 4.

FIG. 4 further discloses a door opening 50 which is positioned within one section of the barrier wall. This is further disclosed in FIG. 5, which is a top view in cross section along the lines 5—5 of FIG. 4. It will be noted that a door opening 53 has been formed between post 18 and a shorter post 54, both of which have been anchored in the ground as illustrated in FIG. 4. An array of shorter sound attenuation devices 11 have been provided to form a door 50, which aesthetically matches the remaining portion of the sound barrier. In this instance, the sound attenuation devices 11 have a shortened length which corresponds to the desired width of the door. These are bolted in vertical, stacked alignment as with the wall structure illustrated in FIG. 2. A hinge mechanism 55 is provided and includes attachment bolts 56 for mounting the hinge to post 18, and a batten 57 extending the height of the door and including means for being bolted to the door construction. A gate clasp 58 is provided at the opposing side of the door to provide for security.

All of the foregoing embodiments represent a common methodology which is applied in accordance with the present invention for reducing sound transmission in a traffic area. It consists of the steps of (i. preparing a plurality of stiff resilient containment members 11, having a channel configuration and enclosed channel volume and a substantially continuous open side, (ii) filling the channel volume with a composite composition comprising rubber chips compressed together with a binder to form a substantially integrated material; and (iii) stacking the containment member horizontally in a nesting relationship with bottom edge to top edge and securing the stacked configuration to form a wall, said open side being oriented toward the traffic area.

It will be apparent to those skilled in the art that the foregoing detailed description of preferred embodiment is merely exemplary. It is to be understood that the scope of the present invention is not to be limited by the specific description provided in the preceding section, but only by the following claims.

I claim:

1. A device for reducing the transmission of sound, comprising:

a stiff, resilient containment member configured as a channel and having an enclosed channel volume and continuous open side, said channel comprising a back wall, and top and bottom walls which are geometrically configured with non-planar, nesting structure to thereby enable a plurality of said devices to be stacked with the respective top wall of a supporting device nesting in the bottom wall of each supported device;

a composite composition of rubber chips and binder compressed within the channel and substantially filling the channel volume; and at least one vertical support rod extending through the respective top and bottom walls of each of the devices when said devices are in a stacked configuration to thereby reinforce said stacked configuration, and means for securing the stacked devices with respect to the support rod.

2. A device as defined in claim 1, wherein the containment member is fabricated of a composition selected from the group consisting of fiber reinforced plastic compositions and metal compositions.

3. A device as defined in claim 1, wherein the containment member is fabricate of fiber reinforced thermosetting resin and is formed by a pultrusion process.

4. A device as defined in claim 1, wherein the geometric nesting structure of the top wall comprises a trapezoidal shape, said bottom wall forming a cavity having a corresponding trapezoidal shape.

5. A device as defined in claim 1, wherein the containment member includes two opposing, continuous, parallel edges, which define top and bottom boundaries of the open side, said parallel edges further including a mounting lip configured to receive a cover plate for concealing the composite composition contained with the channel volume.

6. A device as defined in claim 5, further comprising a cover plate removable attached to the respective lips of the containment member and being operable to conceal the enclosed composite composition.

7. A device as defined in claim 6, wherein the cover plate is perforated to allow transmission of sound waves therethrough.

8. A device as defined in claim 1, wherein a plurality of devices are stacked in the nested configuration and supported at opposing ends by upright support columns, said plurality of devices forming a sound absorption wall useful along a roadside or in other areas where sound reduction is required.

9. A device as defined in claim 8, further comprising a door opening formed in the sound absorption all, said device further comprising a plurality of devices as defined in claim 1 having a shortened length corresponding to a desired width of the door, said shortened devices being stacked horizontally and secured together to form a door which is movably attached at one side to the sound absorption wall to permit access therethrough.

10. A device as defined in claim 1, wherein the binder includes a bonding material which bonds with the rubber crumbs to form a composite composition which can be molded within the channel volume.

11. A device as defined in claim 10 wherein the binder comprises concrete.

12. A device as defined in claim 10, wherein the binder comprises polymeric material.

13. A device as defined in claim 1, wherein the crumbs of rubber comprise recycled tires shredded to a size of less than one cubic centimeter.

14. A sound wall for placement along a roadside for reducing the transmission of sound from traffic areas, said sound wall comprising:

a plurality of stiff, resilient containment members respectively configured as a channel and having an enclosed channel volume and a continuous open side, each channel comprising a back wall and opposing, continuous and parallel top and bottom walls which define top and bottom boundaries of the open side and which are geometrically configured with non-planar, nesting structure to thereby enable a plurality of said containment members to be stacked with the respective top wall of a supporting containment member nesting in the bottom wall of each supported containment member, said parallel top and bottom walls further including a mounting lip configured to receive a cover plate for concealing the composite composition contained within the channel volume;

means for stacking said containment members horizontally in a nesting relationship of bottom wall to top wall and for securing this stacked configuration to form a wall, said open side being oriented toward the traffic area; and at least one vertical support rod extending through the respective top and bottom walls of each of the containment members when said containment members are in a stacked configuration to thereby reinforce said stacked configuration, and means for securing the stacked containment members with respect to the support rod;

said channel volume including a composite composition of rubber chips and binder compressed within the channel and substantially filling the channel volume.

15. A device as defined in claim 14, further comprising a cover plate removeably attached to the respective lips of each containment member and being operable to conceal the enclosed composite composition.

16. A method of reducing sound transmission from a traffic area comprising the steps of:

a) preparing a plurality of stiff, resilient containment members, each containment member configured as a channel and having an enclosed channel volume and continuous open side, each channel comprising a back wall, and top and bottom walls which are geometrically configured with non-planar, nesting structure to thereby enable a plurality of said containment members to be stacked with the respective top wall of a supporting containment members nesting in the bottom wall of each supported containment member;

b) filling each channel volume with a composite composition comprising rubber chips compressed together with a binder to form a substantially integrated material;

c) compiling said containment members in a nesting relationship of top wall to bottom wall and securing this stacked configuration to form a wall, said open side being oriented toward the traffic area;

d) fabricating at least one vertical support rod; and e) positioning said at least one vertical support rod to extend through the respective top and bottom walls of each of the containment members when said containment members are in said stacked configuration to thereby reinforce said stacked configuration, and means for securing the stacked containment members with respect to the support rod.

* * * * *